US007137906B2

(12) United States Patent
Tsunoda et al.

(10) Patent No.: US 7,137,906 B2
(45) Date of Patent: Nov. 21, 2006

(54) GOLF CLUB HEAD

(75) Inventors: Masaya Tsunoda, Kobe (JP); Hisashi Kakiuchi, Kobe (JP); Masahide Ohnuki, Kobe (JP); Hiroto Setokawa, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/321,682

(22) Filed: Dec. 18, 2002

(65) Prior Publication Data

US 2003/0162607 A1 Aug. 28, 2003

(30) Foreign Application Priority Data

Dec. 28, 2001 (JP) ..... 2001-400267

(51) Int. Cl.
*A63B 53/04* (2006.01)

(52) U.S. Cl. ..... 473/324; 473/345

(58) Field of Classification Search ..... 473/324, 473/345, 349, 350

See application file for complete search history.

(56) References Cited

U.S. PATENT DOCUMENTS

| | | | | |
|---|---|---|---|---|
| 4,928,965 | A | 5/1990 | Yamaguchi et al. | |
| 5,346,217 | A * | 9/1994 | Tsuchiya et al. | 473/345 |
| RE34,925 | E * | 5/1995 | McKeighen | 473/305 |
| 6,402,639 | B1 * | 6/2002 | Iwata et al. | 473/330 |
| 6,406,381 | B1 * | 6/2002 | Murphy et al. | 473/345 |
| 6,440,008 | B1 * | 8/2002 | Murphy et al. | 473/324 |
| 6,638,180 | B1 * | 10/2003 | Tsurumaki | 473/329 |
| 6,679,786 | B1 * | 1/2004 | McCabe | 473/305 |
| 2001/0001302 | A1 * | 5/2001 | Murphy et al. | 473/345 |
| 2002/0123394 | A1 * | 9/2002 | Tsurumaki | 473/345 |
| 2003/0162607 | A1 * | 8/2003 | Tsunoda et al. | 473/324 |
| 2004/0009830 | A1 * | 1/2004 | Nishio | 473/345 |
| 2004/0018889 | A1 * | 1/2004 | Yamamoto et al. | 473/345 |

FOREIGN PATENT DOCUMENTS

| | | | |
|---|---|---|---|
| EP | 0 168 041 | | 1/1986 |
| JP | 4-56630 | B2 | 9/1992 |
| JP | 5-33071 | B2 | 5/1993 |
| JP | 08-224328 | B2 | 9/1996 |
| JP | 2000-317016 | A | 11/2000 |
| JP | P2001-120692 | A * | 5/2001 |
| JP | 2001-321471 | A | 11/2001 |
| JP | 2002-017904 | A | 1/2002 |

OTHER PUBLICATIONS

Iwatsubo, Takuzo et al. "Design of Golf Club Head with High Resolution Performance", Japan Society of Mechanical Engineers, pp. 100-104, (2000).

* cited by examiner

*Primary Examiner*—Raleigh W. Chiu
(74) *Attorney, Agent, or Firm*—Birch, Stewart, Kolasch & Birch, LLP

(57) ABSTRACT

A golf club head in which a frequency F (fix) indicating a primary minimum value of a frequency transfer function of a head obtained by firmly fixing the head to a vibrator and measured in accordance with an vibrator method is between 600 and 1200 (Hz), and a frequency F (free) indicating a primary minimum value of a frequency transfer function of the head obtained by making the head in a free state and measured in accordance with an impact hammer method is between 2500 and 4000 (Hz).

17 Claims, 13 Drawing Sheets

GOLF CLUB HEAD

FIELD OF THE INVENTION

The present invention relates to a golf club head which can improve a carry of a ball by increasing a repulsion against the ball to the full.

DESCRIPTION OF THE PRIOR ART

The applicant of the present application has been already proposed that an energy loss generated at a time of collision between a golf club head and a golf ball so as to increase a repulsion and improve a carry of the ball by approximating a frequency indicated by a primary minimum value of a mechanical impedance of the golf club head to a frequency indicated by a primary minimum value of a mechanical impedance of the golf ball. The mechanical impedance is a specific value for a material, however, the value becomes different in accordance with a boundary condition at a time of measuring.

In Japanese Patent Publication No. 4-56630(B2) which the applicant has been already proposed, there has been proposed designing such that a golf club is suspended in a free state and a minimum value of the mechanical impedance of the golf club head in this free state indicates in an area of frequency between 2500 and 4000 Hz. On the contrary, in Japanese Patent Publication No. 5-33071(B2), there has been proposed designing such that a face surface of a head is firmly fixed to a vibrator in a firmly fixed state, and a minimum value of the mechanical impedance of the club head indicates in an area of frequency between 600 Hz and 1600 Hz.

As mentioned above, in the conventional proposal, the structure is made such as to regulate the mechanical impedance of the golf club head in any one boundary condition of the free state of the head and the firmly fixed state, and improve the repulsion by approximating the frequency of the minimum value of the mechanical impedance in any one boundary condition of the free state of the head and the golf ball and the firmly fixed state.

The inventors have devoted themselves to conduct researches for the purpose of achieving an improvement of the further repulsion of the head. As a result, they have found that it is possible to further increase a repulsion efficiency by approximating the frequency in which a frequency transfer function of the head indicates the primary minimum value to the frequency indicating the primary minimum value of a frequency transfer function of the golf ball in accordance with the same measuring boundary condition as that of the club head, respectively at the same time in the two measuring boundary conditions mentioned above, more preferably by making the frequency in which the frequency transfer function of the head indicates the primary minimum value lower than that of the ball in the two measuring methods. For reference's sake, most of the heads of the golf clubs brought to the market at present are made of metallic material and have a hollow structure. When firmly fixing the head made of the material and having the structure to the vibrator and measuring in accordance with an vibrator method, the minimum value of the frequency transfer function sometimes indicates in the area of frequency between 600 Hz and 1600 Hz, as described in Japanese Patent Publication No. 5-33071, however, the frequency in which the frequency transfer function measured in accordance with an impact hammer method in the free state indicates the minimum value becomes a value larger than 4000 Hz, and does not appear in the area between 2500 and 4000 Hz as described in the publication mentioned above.

SUMMARY OF THE INVENTION

The present invention is made by taking the matters mentioned above into consideration, and an object of the present invention is to provide a golf club head which can further increase a repulsion against a ball and can further improve a carry of the ball.

In accordance with the invention described in a first aspect of the present invention, there is provided a golf club head in which a frequency F (fix) indicating a primary minimum value of a frequency transfer function of a head obtained by firmly fixing the head to a vibrator and measured in accordance with an vibrator method is between 600 and 1200 (Hz), and a frequency F (free) indicating a primary minimum value of a frequency transfer function of the head obtained by placing the head in a free state and measured in accordance with an impact hammer method is between 2500 and 4000 (Hz).

In this case, the "frequency transfer function of the head measured in accordance with the vibrator method" can be determined by the following formula in which an acceleration of an vibration point (a firmly fixed point between the vibrator and the head) at a time when the exciting machine excites the head is set to $\alpha 1$, and a response acceleration is set to $\alpha 2$.

Frequency transfer function=(power spectrum of $\alpha 1$ )/(power spectrum of $\alpha 2$ )

Further, the vibrator method is structured such as to measure a response in the head side obtained by firmly fixing the head to the vibrator and generated on the basis of the vibration from the vibrator. In the present specification, the "vibrator method" is defined as performing the following measurement.

(1) First, the head is taken out from the shaft of the golf club (this step is not required in the case that the head simple body is previously prepared).

(2) As shown in FIG. 8 and FIG. 10, an vibrating member 12 (having a cylindrical shape with an outer diameter 10 mm) of a vibrator 13 is firmly fixed to a sweet spot S of a face surface 2 of a head 1 by an adhesive agent. It is firmly fixed to the sweet spot S because of preventing a moment from being generated due to an eccentricity at a time of vibration. In this case, the sweet spot S is a point in which a perpendicular line dropped from a center of gravity in the head intersects the face surface, however, as a matter of convenience, may be determined as a position at which the head is balanced by being mounted on an upper end of a pipe, for example, having an inner diameter 1.5 mm and an outer diameter 2.5 mm in a state of directing the face surface downward.

(3) As shown in FIG. 8, an acceleration pickup Pa2 is firmly fixed to a suitable position (in the present embodiment, a position 20 mm apart from the sweet spot S to a toe side as shown in FIG. 10) of the face surface 2 in which the vibration of the head 1 can be measured, for example, by an adhesive agent.

(4) As shown in FIG. 8, an acceleration pickup Pa1 for measuring an acceleration of the vibration point at a time when the vibrator 13 vibrates the head is mounted to an input jig 15.

(5) As shown in FIG. 9, the vibration is applied to the head 1 by the vibrator 13, and a signal of the acceleration α1 of the input jig 15 and a signal of the acceleration α2 of the head 1 are taken in an FFT analyzer via a power unit.

(6) The frequency transfer function is determined by the FFT analyzer (on the basis of the formula power spectrum α1/power spectrum α2).

(7) FIG. 4 shows a measurement result of the frequency transfer function. On the basis of the graph mentioned above, the frequency F (fix) (a minimum frequency among the frequencies indicating a plurality of minimum values) indicating the primary minimum value of the frequency transfer function of the head obtained by firmly fixing the head to the vibrator and measured in accordance with the vibrator method is read.

Further, the impact hammer method is structured such as to suspend the head or the golf club in a free state and strike the head by the impact hammer so as to measure the response. In the present specification, the impact hammer method is defined as a method of performing the following measurement.

(1) As shown in FIG. 11, first, a string is attached to a grip G side of a golf club CB and a head is set in a suspended state in which the head is directed downward (the head simple body may be suspended).

(2) The acceleration pickup Pa2 is firmly fixed to a suitable position (in the present embodiment, a position 20 mm apart from the sweet spot S to a toe side as shown in FIG. 10) of the face surface 2 in which the vibration of the head 1 can be measured, for example, by an adhesive agent.

(3) The sweet spot S of the face surface is struck by an impact hammer HM.

(4) An vibration force F1 (measured by a force pickup Pa3 attached to the impact hammer) of the impact hammer and an acceleration α2' of the head 1 obtained from the acceleration pickup Pa2 are taken in the FFT analyzer via the power unit.

(5) The frequency transfer function is determined by the FFT analyzer (on the basis of the formula power spectrum F1/power spectrum α2').

(6) FIG. 5 shows a measurement result of the frequency transfer function obtained by the impact hammer method. On the basis of the graph mentioned above, in the same manner as mentioned above, it is possible to read the frequency F (free) indicating the primary minimum value of the frequency transfer function of the head obtained by making the head in the free state and measured in accordance with the impact hammer method.

Here, one example of the device used for measuring the frequency transfer function is shown in Table 1.

TABLE 1

| MEASURING DEVICE | | MODEL TYPE | NAME OF MAKER |
|---|---|---|---|
| FFT ANALYZER | | 3562A | YOKOGAWA HEWLETT-PACKARD |
| VIBRATOR | MAIN BODY | 513A | SHIN-NIPPON MEASUREMENT DEVICE |
| | POWER AMPLIFIER | 360-B | COMPANY |
| ACCELERATION PICKUP Pa2 | | 352B22 | PCB(PCB PIEZOTRONICS, INC.) |
| ACCELERATION PICKUP Pa1 | | 353B17 | |
| POWER UNIT | | 482A18 | |
| IMPACT HAMMER | | D86B03 | |

Further, in accordance with the invention described in a second aspect, there is provided a golf club head as described in the first aspect, in which the frequency F (fix) is between 600 and 1000 (Hz), and the frequency F (free) is between 2500 and 3800 (Hz).

Further, in accordance with the invention described in a third aspect, there is provided a golf club head as described in the first aspect, in which the frequency F (fix) is between 600 and 900 (Hz), and the frequency F (free) is between 2500 and 3500 (Hz).

Further, in accordance with the invention described in a fourth aspect, there is provided a golf club head as described in anyone of the first to third aspects, in which a rate F (free)/F (fix) between the frequency F (fix) and the frequency F (free) is between 4.2 and 6.0.

Further, in accordance with the invention described in a fifth aspect, there is provided a golf club head as described in any one of the first to fourth aspects, in which a thickness of a face portion is not more than 2.7 mm, a thickness of a crown portion forming a head upper surface is not more than 0.9 mm, a thickness of a sole portion forming a head bottom surface is not more than 1.0 mm, and wherein the head when mounted on a horizontal surface to have a set lie angle and face angle, with a vertical cross section passing through a center of the face portion and being perpendicular to the face surface and the horizontal surface, has a smallest radius of curvature of an outer surface in the crown portion is not less 500 mm, and a smallest radius of curvature of an outer surface in the sole portion is not less than 1000 mm.

Further, in accordance with the invention described in a sixth aspect, there is provided a golf club having the head described in any one of the first to fifth aspects.

DESCRIPTION OF THE PREFERRED EMBODIMENTS

A description will be given below of one embodiment in accordance with the present invention with reference to the accompanying drawings.

Figure 1:
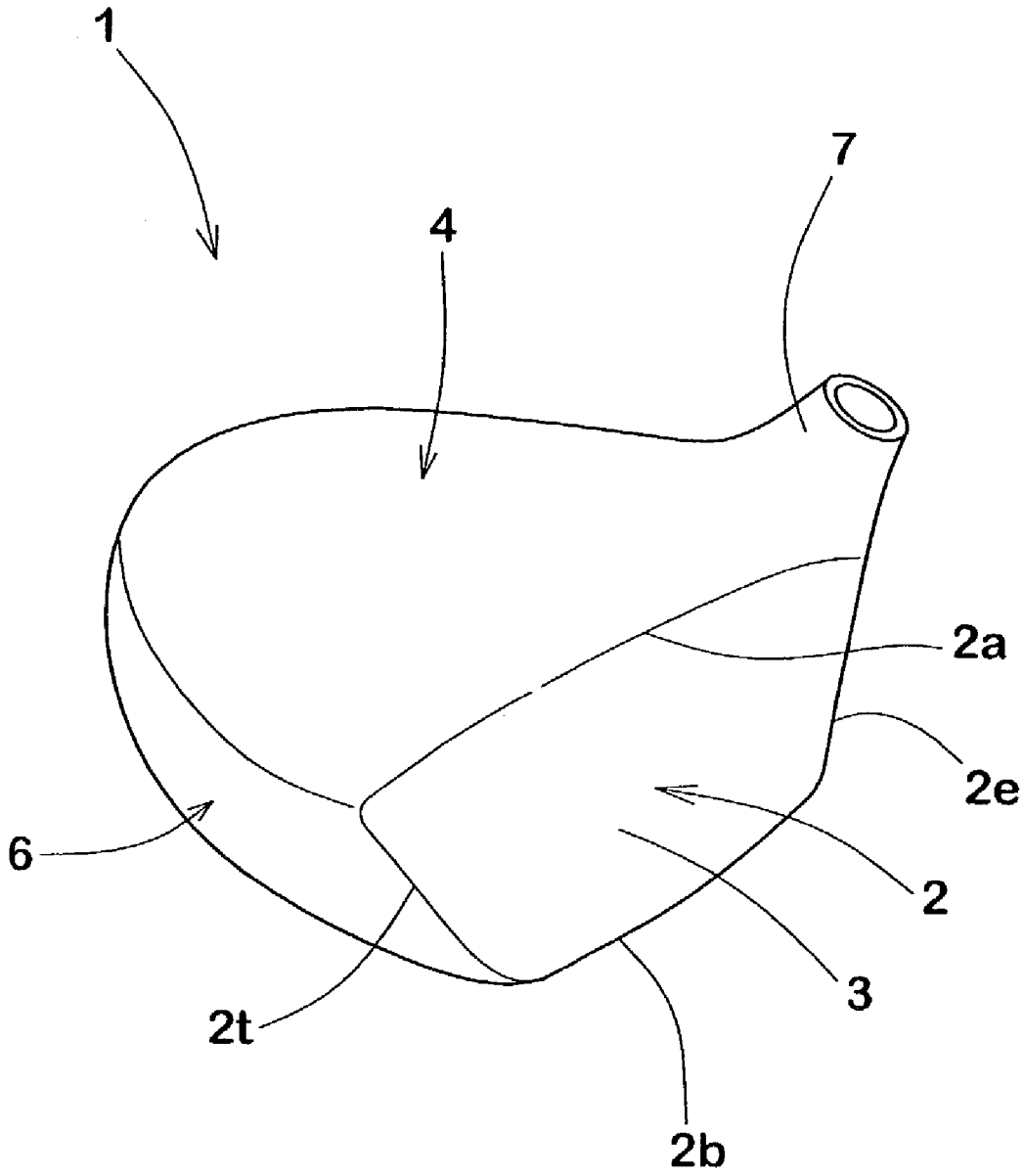
FIG. 1 is a perspective view of a head in a regular state.
Figure 2:
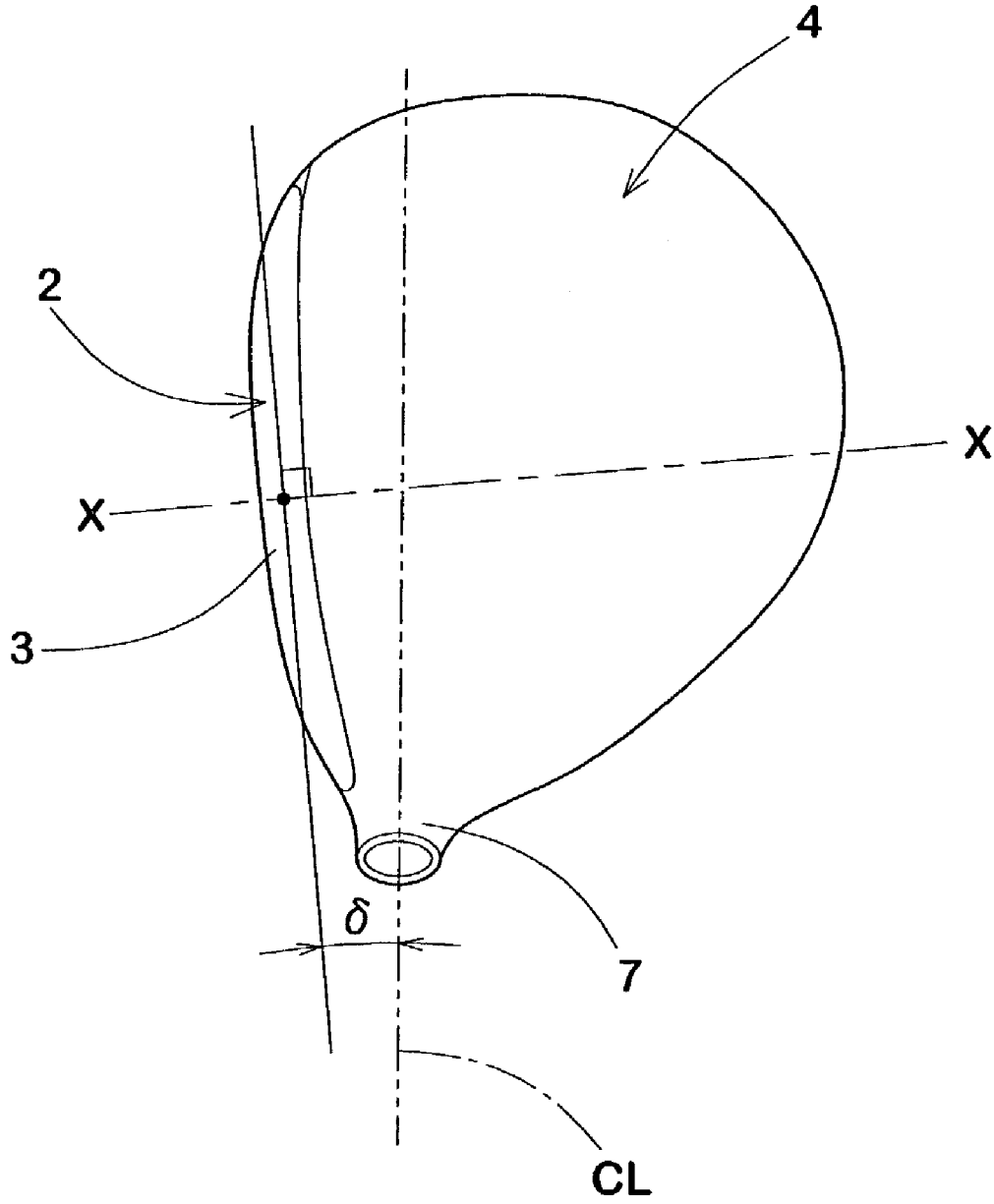
FIG. 2 is a plan view of the head.
Figure 3:
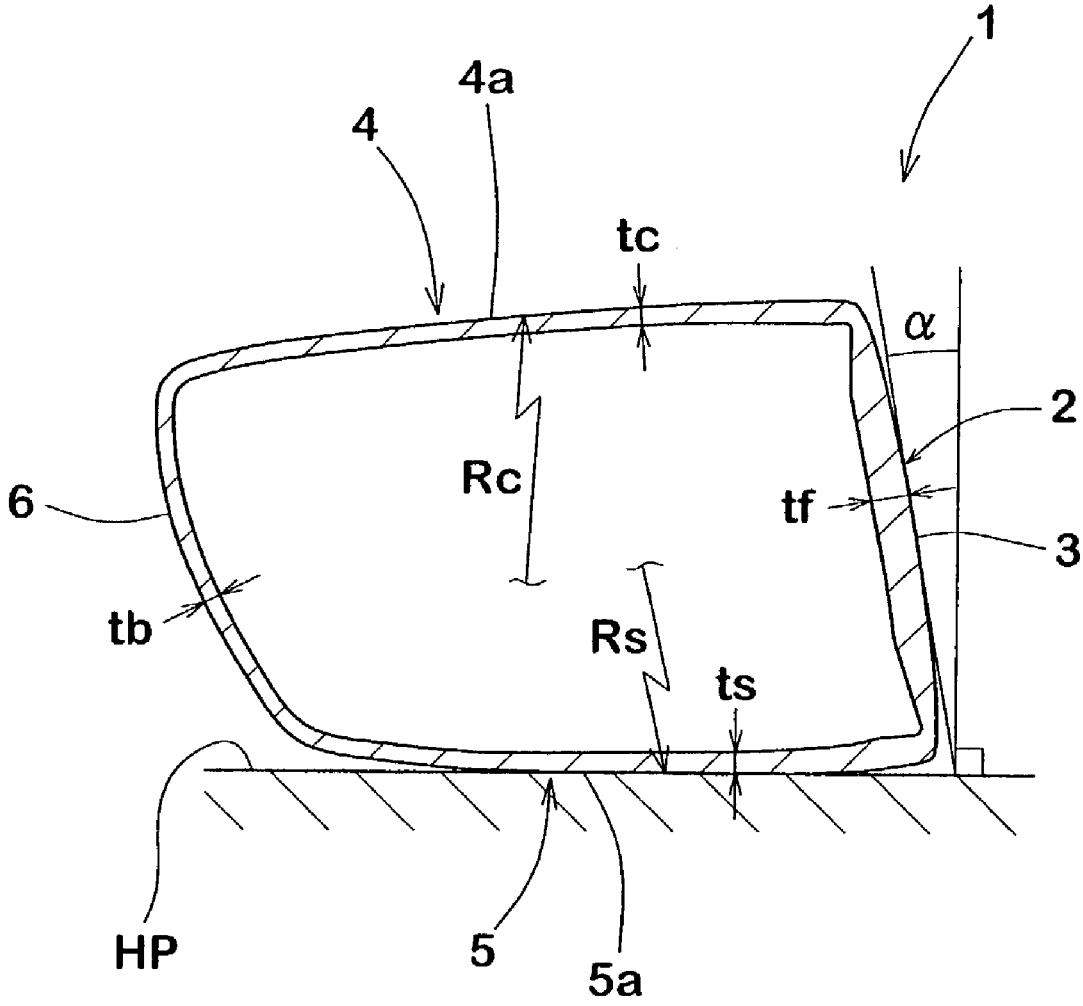
FIG. 3 is a cross sectional view along a line X—X in FIG. 2.
Figure 4:
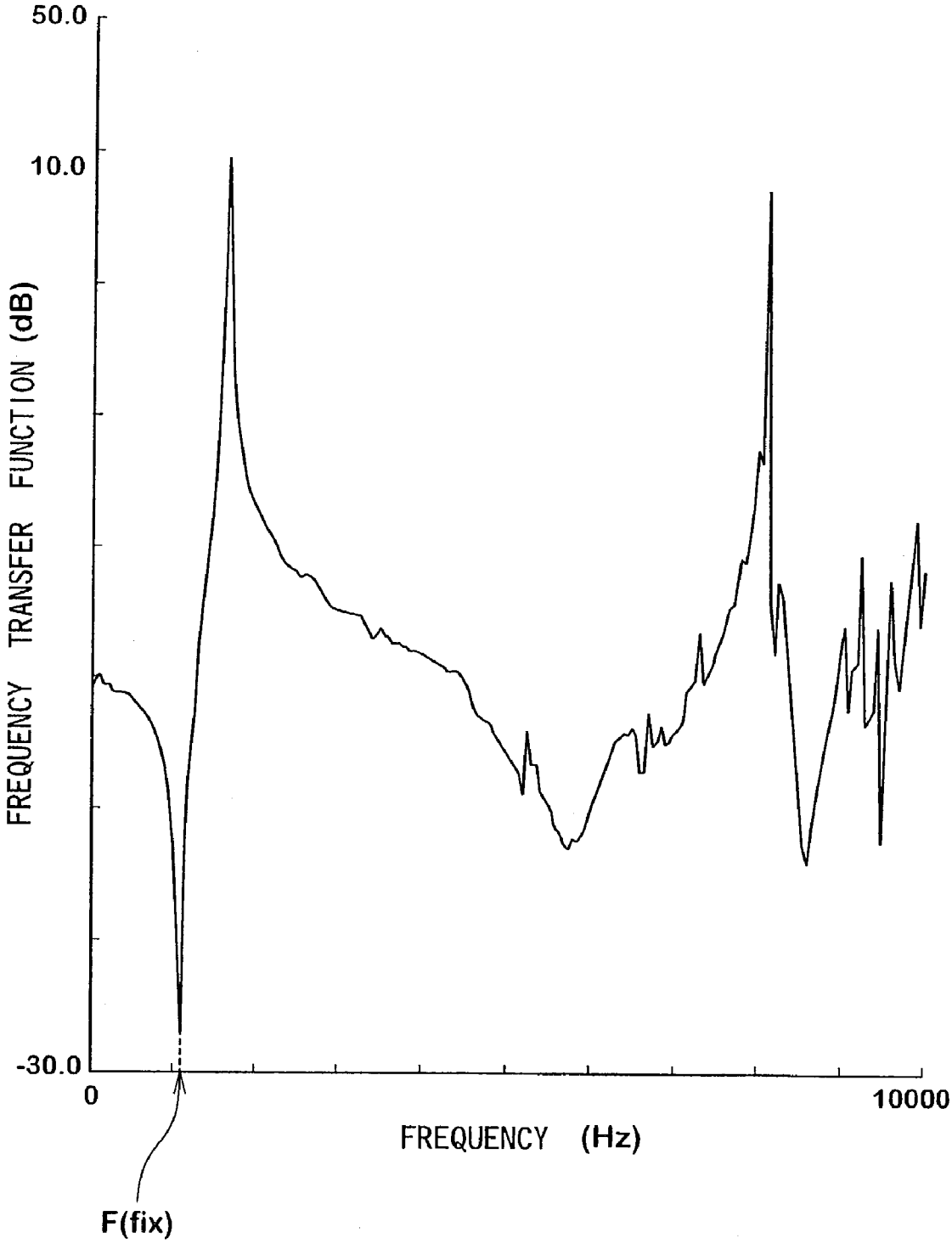
FIG. 4 is a graph showing a frequency transfer function of a head in accordance with an vibrator method.
Figure 5:
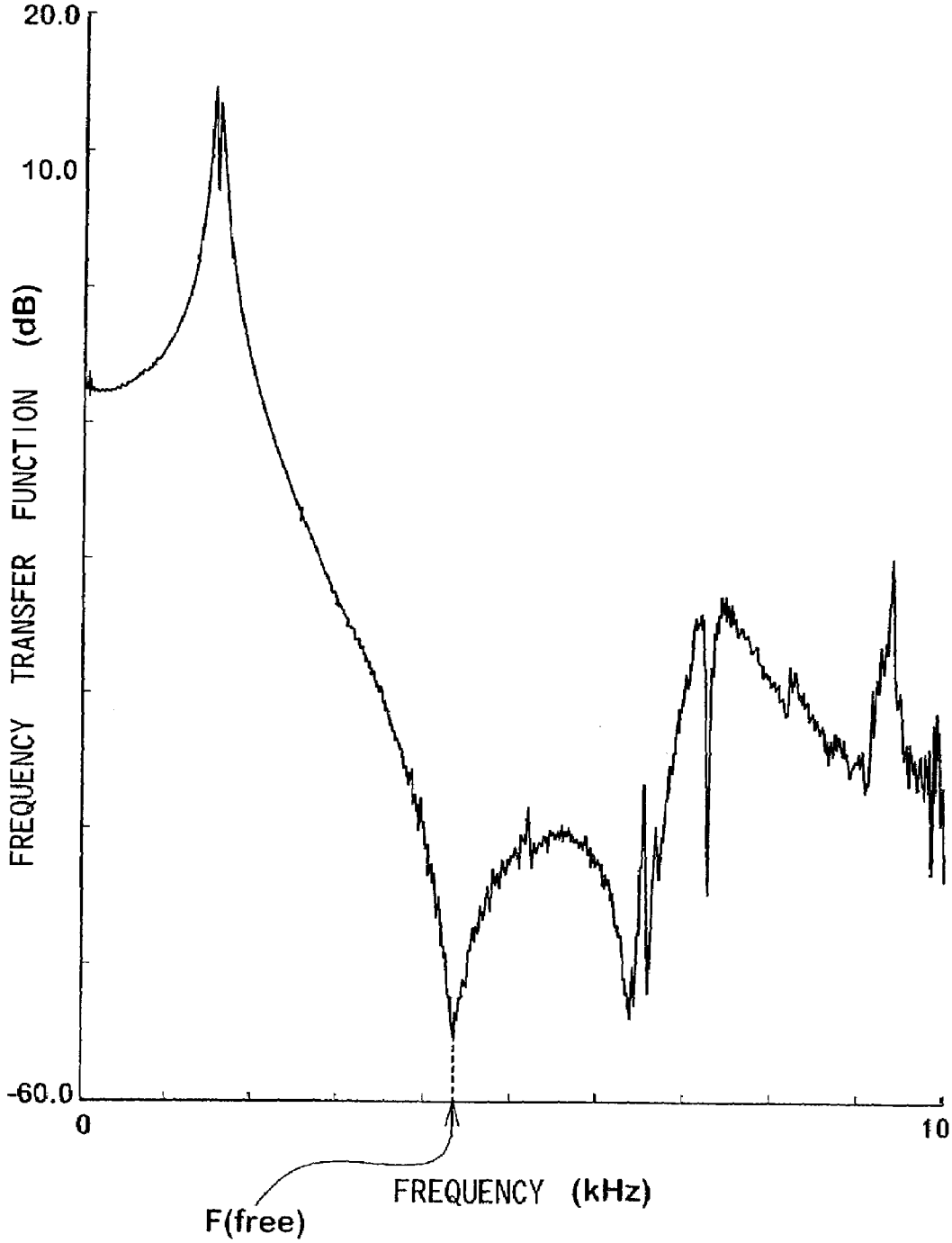
FIG. 5 is a graph showing a frequency transfer function of a head in accordance with an impact hammer method.

A wood type golf club head (hereinafter, refer simply to a "head") 1 as shown in FIGS. 1 to 3 is set in a regular state in which the head 1 is mounted on a horizontal surface HP with a set lie angle and face angle δ. In this case, in the regular state, an axial center line CL of a shaft provided in a neck portion 7 of the head 1 is arranged within a vertical surface and is aligned with a lie angle.

The head 1 is provided with a face portion 3 having a face surface 2 corresponding to a surface hitting a ball as an outer surface, a crown portion 4 connected to an upper edge 2*a* of the face surface 2 and forming a head upper surface, a sole portion 5 connected to a lower edge 2*b* of the face surface 2 and forming a head bottom surface, a side portion 6 connecting between the crown portion 4 and the sole portion 5 and extending from a toe edge 2*t* of the face surface 2 to a heel edge 2*e* of the face surface 2 through a back face, and the neck portion 7 arranged near an intersection portion in the heel side in which the face portion 3, the crown portion 4 and the side portion 6 intersect, and to which one end of a shaft (not shown) is attached. In the present embodiment, a metal structure having a hollow shape in an inner portion is exemplified.

In the head 1, a frequency F (fix) indicating a primary minimum value of a frequency transfer function of the head obtained by firmly fixing the head to a vibrator and measured in accordance with an vibrator method is set between 600 and 1200 (Hz), and a frequency F (free) indicating a primary minimum value of a frequency transfer function of the head obtained by making the head in a free state and measured in accordance with an impact hammer method is set between 2500 and 4000 (Hz). In this case, the measuring method of each of the frequencies F (fix) and F (free) is as described above. The inventors of the present application measure the frequencies indicating the primary minimum value of the frequency transfer function of the general golf ball used for playing a golf in accordance with the vibrator method and the impact hammer method, respectively. The results are shown in Table 2.

Figure 12:
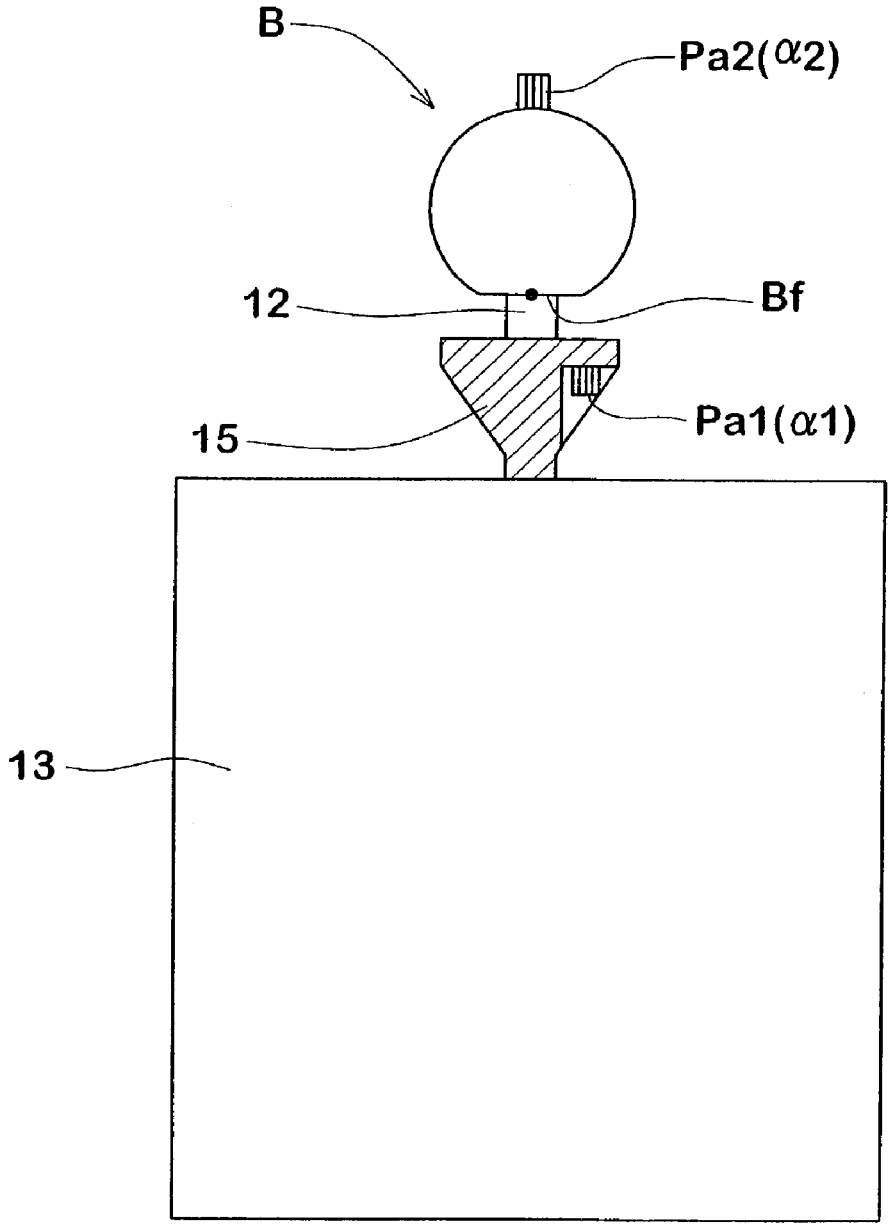
FIG. 12 is a graph showing a measuring method of a golf ball in accordance with the vibrator method.

In this case, as shown in FIG. 12, at a time of measuring the frequency transfer function of a golf ball B in accordance with the vibrator method, a flat surface Bf having a diameter 10 mm is formed on a surface of the golf ball B by scraping the golf ball B, and an vibration member 12 (formed in a cylindrical shape having an outer diameter 10 mm) of the vibrator 13 is firmly fixed to the flat surface Bf by an adhesive agent. Further, an acceleration pickup Pa2 capable of detecting an acceleration of the ball is mounted to a position inverted at 180 degrees from the vibration member 12. The other structures are the same as those of the case of the head.

Figure 13:
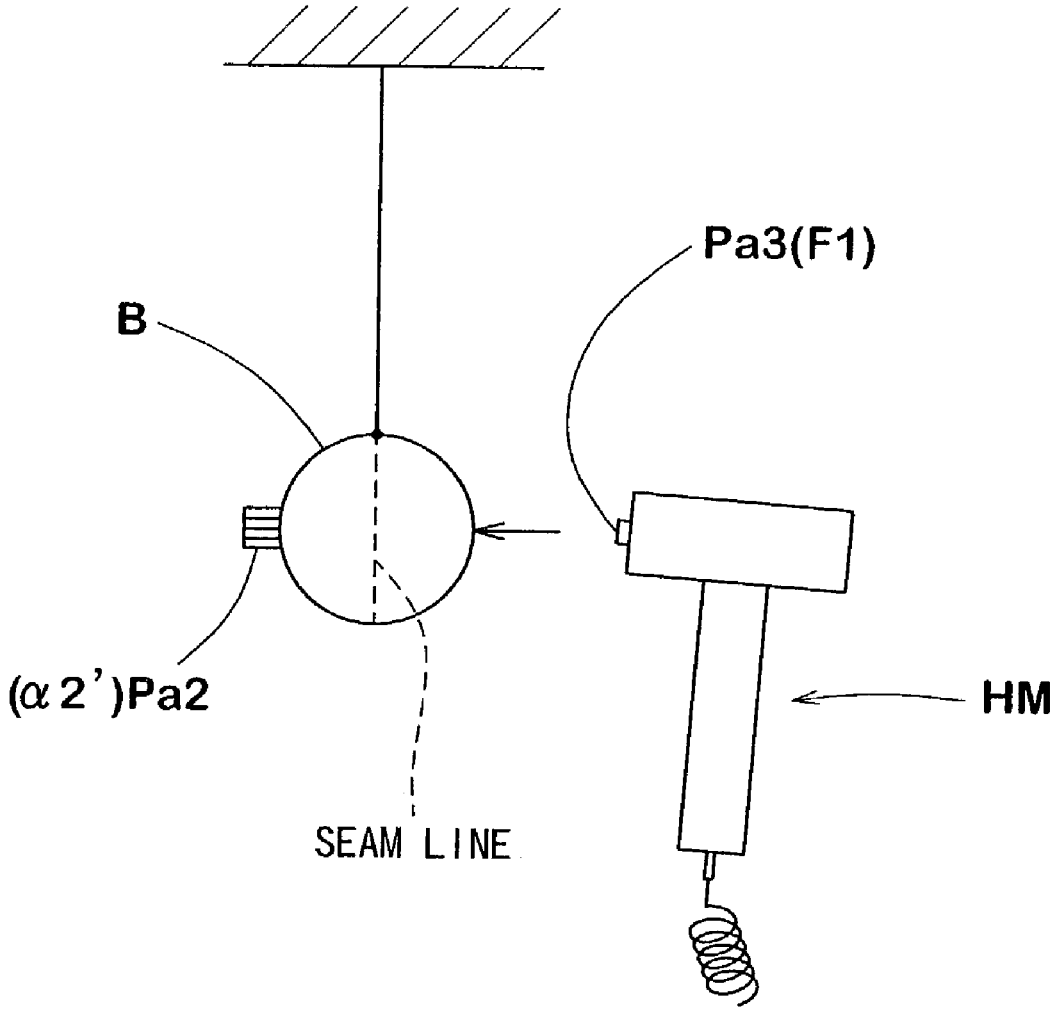
FIG. 13 is a graph showing a measuring method of the golf ball in accordance with the impact hammer method.

Further, as shown in FIG. 13, at a time of measuring the frequency transfer function of the golf ball B in accordance with the impact hammer method, the measurement is executed by holding the golf ball B in a state of suspending the golf ball B by a string firmly fixed to a seam portion by means of an instant adhesive agent, and striking one of pole portions by an impact hammer HM. In this case, the acceleration pickup Pa2 measuring an acceleration of the ball is firmly fixed to a pole portion in an opposite side to the striking position by using an instant adhesive agent. The other structures are the same as those of the case of the head.

As is apparent from Table 2, a frequency FB(fix) indicating a primary minimum value of the frequency transfer function of the golf ball measured in accordance with the vibrator method is included in the range between 950 and 1100 Hz. In this case, it is estimated that the other model type golf ball will be also included approximately in this range. Accordingly, the frequency F (fix) indicating the primary minimum value of the frequency transfer function of the head 1 measured in accordance with the vibrator method is made approximate to the frequency FB(fix) of the golf ball, and more preferably, the frequency F (fix) of the head is set slightly lower than the frequency FB(fix) of the ball. In particularly preferable, the frequency F (fix) is set between 600 and 1000 Hz, more preferably between 600 and 900 Hz.

In the same manner, the frequency FB(free) indicating the primary minimum value of the frequency transfer function of each of the balls measured in accordance with the impact hammer method is included approximately in a range between 3242 and 3940 Hz. Accordingly, the frequency F (free) indicating the primary minimum value of the frequency transfer function of the head 1 measured in accordance with the impact hammer method is made approximate

TABLE 2

| KIND OF GOLF BALL (MODEL TYPE) | FREQUENCY INDICATING PRIMARY MINIMUM VALUE OF FREQUENCY TRANSFER FUNCTION MEASURED IN ACCORDANCE WITH VIBRATOR METHOD FB(fix) [Hz] | FREQUENCY INDICATING PRIMARY MINIMUM VALUE OF FREQUENCY TRANSFER FUNCTION MEASURED IN ACCORDANCE WITH IMPACT HAMMER METHOD FB(free) [Hz] |
|---|---|---|
| SF: DDH TOUR SPECIAL SF | 980 | 3305 |
| RB: DDH TOUR SPECIAL RB | 990 | 3508 |
| SM: TOUR SPECIAL SOFT METAL | 974 | 3297 |
| HB: HY-BRID | 950 | 3242 |
| XXIO(R): XXIO REGULAR | 951 | 3289 |
| XXIO(H): XXIO HARD SPEC | 981 | 3383 |
| OPTIMA(HP): OPTIMAHP | 1041 | 3370 |
| Pinnacle Gold: Pinnacle Gold (ACUSHNET COMPANY) | 1100 | 3940 |

to the frequency FB(free) of the golf ball, and more preferably, the frequency F (free) of the head is set slightly lower than the frequency FB(free) of the ball. In particularly preferable, the frequency F (free) is set between 2500 and 3800 Hz, more preferably it is desirable to set between 2500 and 3500 Hz.

Further, two frequencies F (fix) and F (free) indicating the vibration characteristics of the head 1 have a correlation. In the general conventional head, a ratio (=F (free)/F (fix)) between two frequencies is between 3.5 and 4.1. In the present embodiment, it is desirable to set the ratio between two frequencies (within the range of the frequency satisfying the requirement mentioned above) between 4.2 and 6.0 for the purpose of increasing the repulsion against the ball to the full. When the ratio becomes larger than 6.0, the frequency F (free) of the head 1 largely deflect from the frequency F (free) of the ball, so that the repulsion tends to be low.

It is possible to change the ratio between two frequencies F (fix) and F (free) to some extent. As mentioned above, the frequencies indicating the vibration characteristics of the head 1 have the correlation (approximately linear correlation), and as the frequency F (fix) of the head 1 is lowered, the frequency F (free) also tends to be lowered. However, it is possible to change the ratio (=F (free)/F (fix)) between two frequencies by changing rigidity, weight distribution, thickness distribution or the like of each of the portions in the head 1, and by extension, it is possible to set two frequencies of the head optimum.

As one example, a rigidity of a face portion 3 becomes low as a face thickness of a certain reference head 1 is made thin. Accordingly, F (fix) comes down (F (free) slightly drops down accordingly), however, F (free) is increased by distributing this extra thickness to the crown and sole portions. The ratio (F (free)/F (fix)) between two frequencies can be changed by changing the rigidity, the weight distribution, the thickness distribution or the like of each of the portions in the head as in this example.

As mentioned above, in any boundary condition of the fixed state and the free state of the head 1, it is possible to further increase the repulsion against the ball in comparison with the conventional one by setting the frequencies F (fix) and F (free) indicating the primary minimum value of the frequency transfer function of the head 1 approximate to those of the golf ball or lower than those of the golf ball, whereby it is possible to further increase the carry of the ball. This can be ascertained by various kinds of experimental results.

In order to set the frequencies F (fix) and F (free) indicating the primary minimum value of the frequency transfer function of the head 1 within the range mentioned above, it is effective to make the face portion 3 or a whole of the head be easily flexible at a time of hitting the ball, for example, by employing the following structures:

a) using a material having a low Young's modulus for the face portion 3 or the whole of the head 1;

b) reducing the thickness of each of the portions in the head; and c) reducing the rigidity of the head or the face portion 3.

As mentioned above, a metallic material having a low Young's modulus together with a high strength is preferably used for the head 1, for example, it is desirable to use a titanium alloy such as Ti-6Al-4V, Ti-15V-3Cr-3Al-3Sn and the like, an amorphous alloy, or the like. In this case, the material is not particularly limited as far as it satisfies the requirement of the frequencies F (fix) and F (free), and it goes without saying that various kinds of materials can be employed. Further, a volume of the head 1 is not particularly limited, however, preferably not less than 250 $cm^3$, more preferably not less than 300 $cm^3$, and further preferably it is desirable to increase the size to an extent between 300 and 500 $cm^3$.

Further, the head 1 in accordance with the present embodiment will be exemplified by a head in which the thickness of each of the portions is set as follows, and the radius of curvature in each of the outer surfaces of the crown portion 4 and the sole portion 5 is defined in a vertical cross section X—X (shown in FIGS. 2 and 3) passing through a center of the face portion 3 (the center of the face portion 3 is a point passing through a middle of width and height of the face surface 2) hitting the ball and being perpendicular to the horizontal surface, in the regular state of the head 1.

That is, the face portion 3 is structured, as shown in FIG. 3, such that a maximum thickness tf thereof is not more than 2.7 mm. The face portion 3 in accordance with the present embodiment is exemplified by a face portion in which a thickness is gradually reduced from a center portion toward a peripheral portion. Accordingly, it is preferable in view that it is possible to secure a strength in the face center portion having a great impact force at the hitting time and it is possible to effectively deflect the face portion 3 by the thinned peripheral portion. In particularly preferable, the thickness tf of the face portion 3 is set to about 2.0 to 2.7 mm, more preferably about 2.3 to 2.7 mm. Further, it is desirable to set the minimum thickness of the peripheral portion of the face portion 3 about 1.0 to 2.5 mm, more preferably about 1.5 to 2.4 mm.

Further, in the head 1, it is desirable to set the thickness tc of the crown portion 4 is not more than 0.9 mm, more preferably between 0.5 and 0.9 mm, further preferably between 0.7 and 0.9 mm. As mentioned above, structuring the thickness tc of the crown portion 3 thin is useful for increasing the deflection of the whole of the head. In this case, when the thickness of tc of the crown portion 3 becomes less than 0.5 mm, a durability of the head tends to extremely come down. Accordingly, this thickness is not preferable.

Further, in the head 1, it is desirable to set the thickness ts of the sole portion 5 in not more than 1.0 mm, more preferably between 0.5 and 1.0 mm, and further preferably about 0.7 to 1.0 mm. As mentioned above, structuring the thickness ts of the sole portion 5 thin is useful for further increasing the deflection of the whole of the head together with the thinness of the crown portion 4. In this case, when the thickness ts of the sole portion 4 is less than 0.5 mm, the durability of the head tends to extremely come down. Accordingly, this thickness is not preferable.

Further, in the head 1, it is desirable to set the thickness tb of the side portion 6 is not more than 2.0 mm, more preferably between 0.5 and 1.5 mm, and further preferably about 0.5 to 1.0 mm. As mentioned above, structuring the thickness tb of the side portion 6 thin is useful for further increasing the deflection of the whole of the head together with the thinness of the crown portion 4 and the sole portion 5. In this case, when the thickness tb of the side portion 6 is less than 0.5 mm, the durability of the head tends to extremely come down. Accordingly, this thickness is not preferable.

In the case that the thicknesses tc, ts or tb of the crown portion 3, the sole portion 4 or the side portion 6 changes non-uniformly, each of the thickness tc, ts or tb is specified by an average value weighted by an area ratio. Further, the thickness of the portion on which a weld bead is applied is excepted. Further, in the case of making the crown portion 4, the sole portion 5 and the side portion 6 thin as mentioned above, a molten metal flow is deteriorated in a metal casting of a lost wax or the like, particularly a metal casting of a titanium alloy, and a molding defect tends to be generated. Accordingly, it is desirable to use, for example, a rolled material, a cast material, a press material or the like for the crown portion 3, the sole portion 4 and the side portion 5.

Further, in the head 1, in the vertical cross section X—X, it is preferable to set a smallest radius of curvature Rc of a profile line formed by the outer surface 4*a* of the crown portion 4 is not less than 500 mm, and more preferably not less than 600 mm, and further preferably between 600 and 800 mm. In the same manner, in the vertical cross section X—X, it is preferable to set the smallest radius of curvature Rc of the profile line (patterns or the like are ignored) formed by the outer surface 5*a* of the sole portion 5 is not less than 1000 mm, more preferably not less than 1200 mm, and further preferably between 1200 and 1500 mm. Further, a good balance can be achieved by setting a ratio (Rc/Rs) between the radius of curvature Rc of the crown portion 4 and the radius of curvature Rs of the sole portion 5 about 0.4 to 0.6, however, this is not particularly limited.

Figure 6:
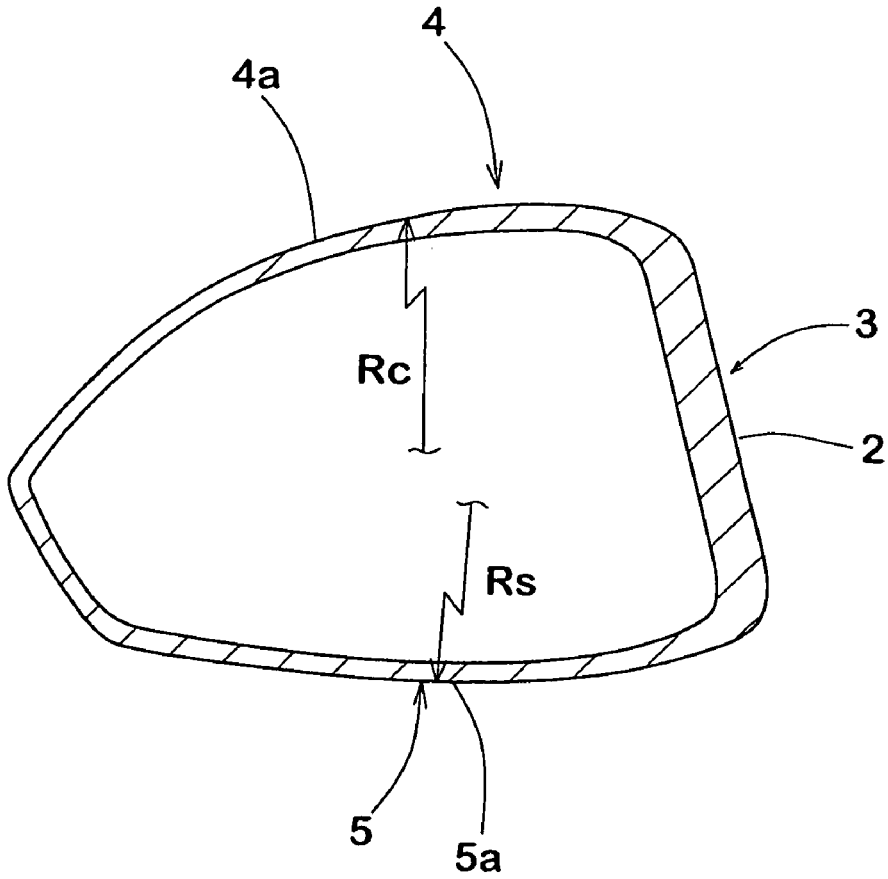
Fig.6 CONVENTIONAL ART
FIG. 6 is a cross sectional view of another head along a line X—X.

As shown in FIG. 6, in the conventional head 1, the outer surface 4*a* of the crown portion 4 is formed in a circular arc shape protruding to an outer side of the head in the vertical cross section X—X, and the radius of curvature Rc thereof is set smaller than 500 mm, approximately 100 to 300 mm. In the same manner, in the vertical cross section X—X, the outer surface 5*a* of the sole portion 5 is formed in a circular arc shape protruding to the outer side of the head, and the radius of curvature Rc thereof is set smaller than 1000 mm, approximately 100 to 500 mm. In the head mentioned above, there is a limit for largely deflecting the crown portion 4 and the side portion 5 at a time of hitting the ball.

Figure 7A:
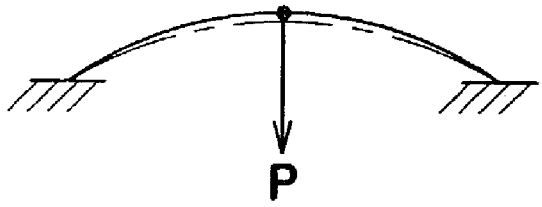
FIGS. 7A and 7B are schematic views describing a deflection of beam.
Figure 7B:
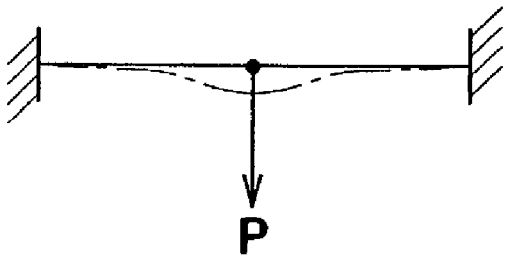
Figure 8:
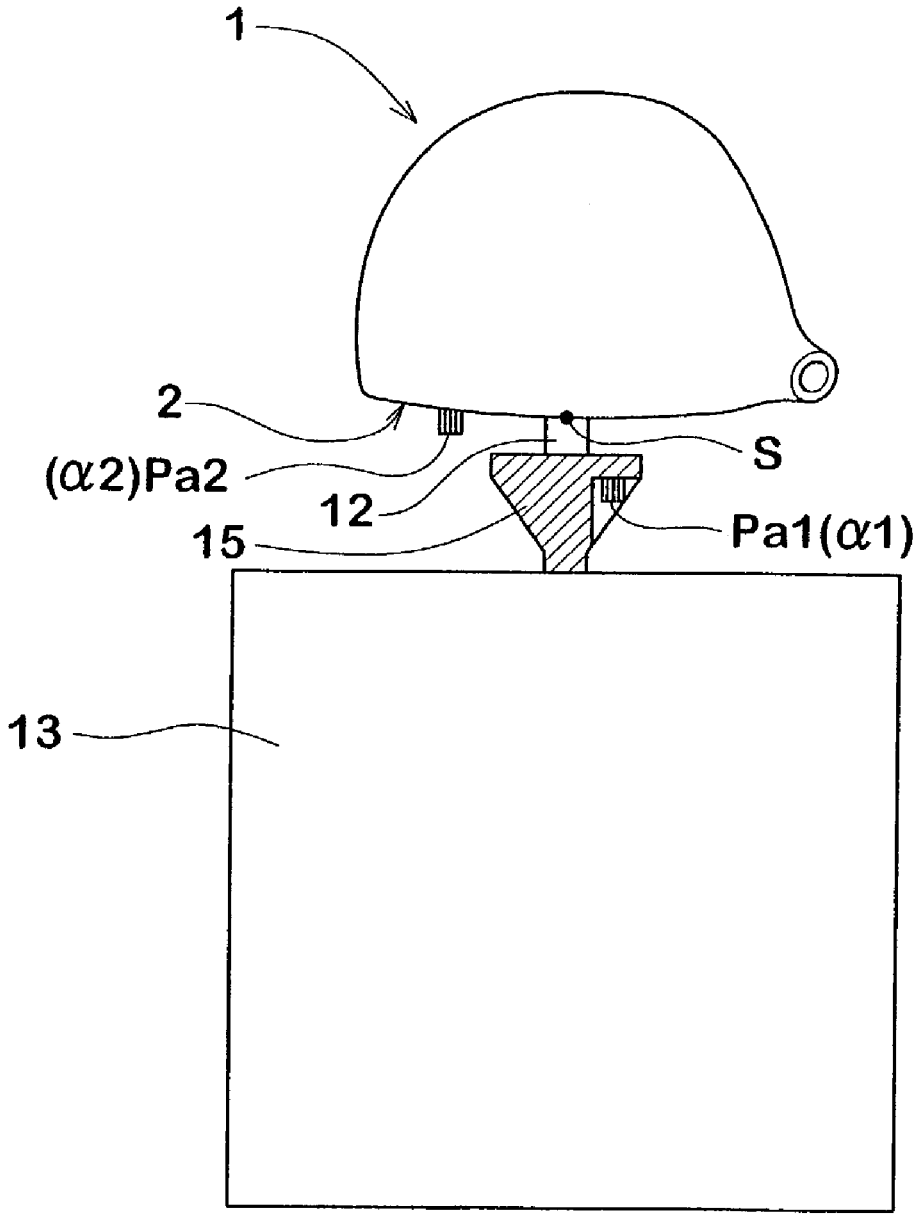
FIG. 8 is a graph describing the vibrator method.
Figure 9:
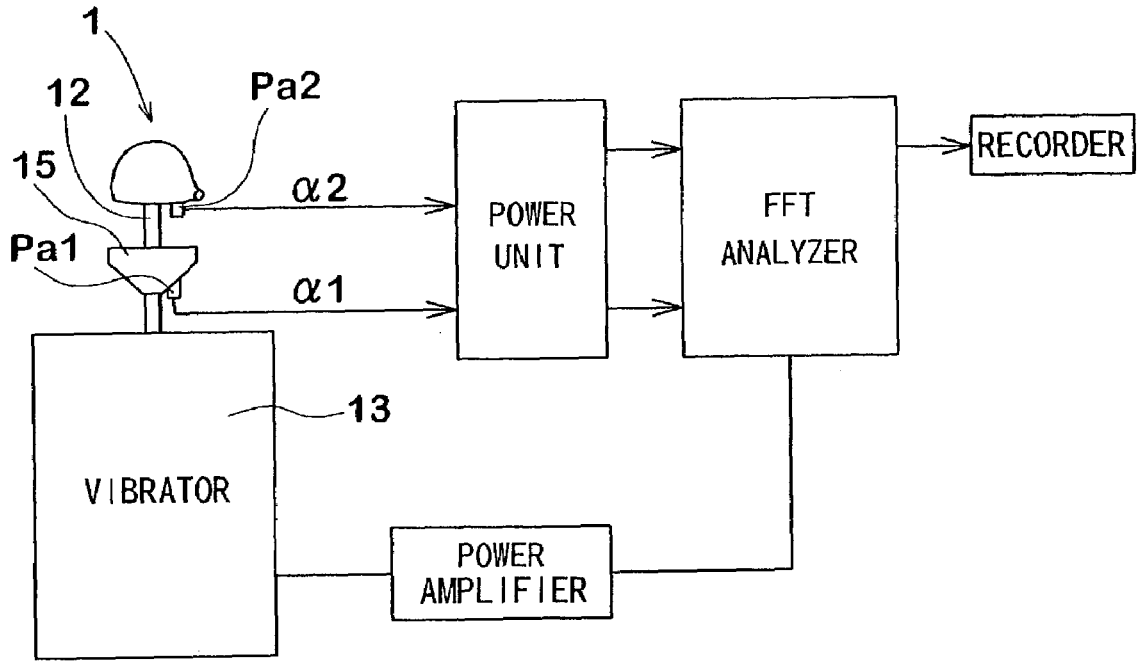
FIG. 9 is a block diagram of a whole describing the vibrator method.
Figure 10:
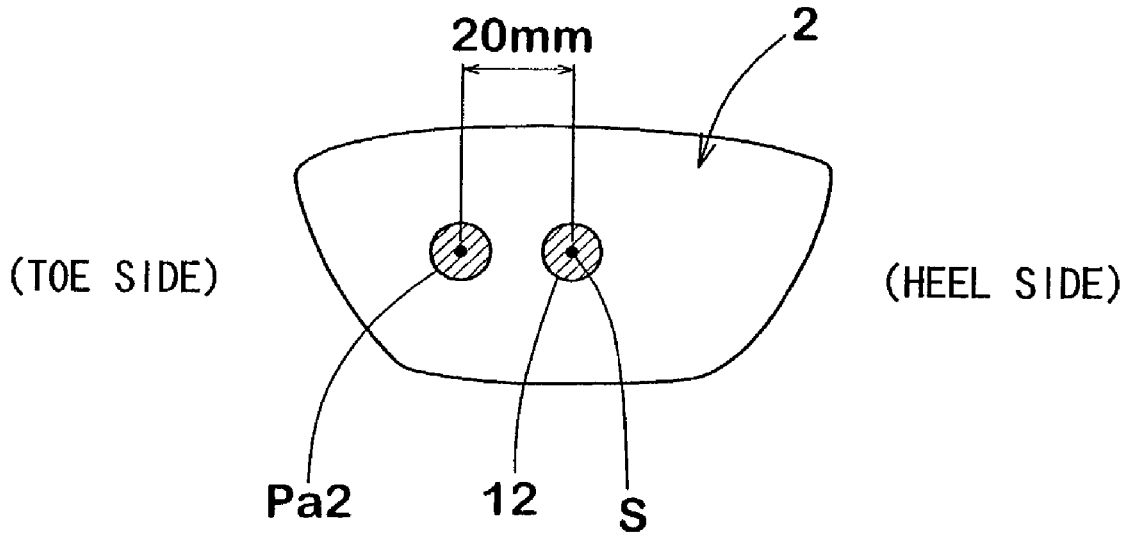
FIG. 10 is a graph of a face surface.
Figure 11:
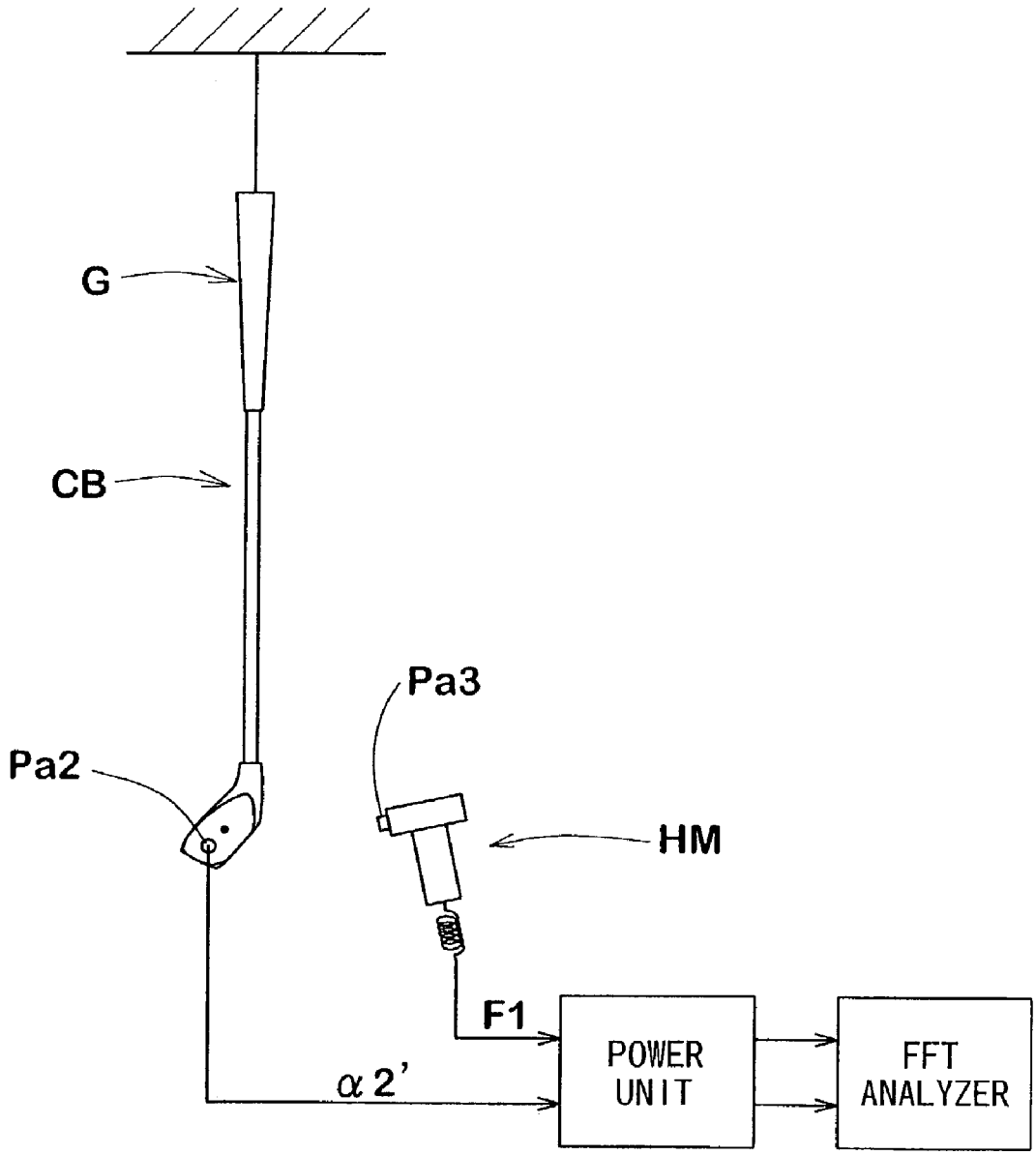
FIG. 11 is a graph describing the impact hammer method.

Then, in accordance with the present embodiment, in the vertical cross section X—X, the crown portion 4 and the sole portion 5 can be further largely deflected at a time of hitting the ball by making the crown portion 4 and the sole portion 5 flat in comparison with the conventional one. That is, as the crown portion 4 is schematically shown in FIGS. 7A and 7B, the deflection against a load P is larger in a straight beam in FIG. 7B rather than a curved beam in FIG. 7A. As mentioned above, the description was given of one example of the present invention, however, the head is not limited to the shape mentioned above as far as it satisfies the requirement of the frequency transfer function, and various kinds of shapes and the like can be employed.

Next, a description will be given of an embodiment in which the present invention is further bodies.

In order to confirm the effect of the present invention, plural kinds of wood type golf club heads are manufactured by trial on the basis of the specification shown in Table 3, the hitting test is performed, and the carry of the ball is measured. The head is manufactured by the titanium (Ti-6Al-4V) in accordance with a lost wax manufacturing method. Further, after casting, the respective portions of the head are finished to predetermined thickness and shape in accordance with a polishing step. The specification is commonly unified to a real loft angle 11 degrees, a lie angle 56 degrees, a head volume 300 $cm^3$ and a head weight 190 g±1.0 g.

The hitting test is performed by attaching the same FRP shaft to each of the test heads so as to manufacture the 46 inch wood type golf club, mounting the club to a swing robot, adjusting a head speed to 40 m/s, and hitting four kinds of golf balls at a sweet spot by each of the clubs every five balls. Then, the speed ratio (initial velocity of ball/head speed) is determined by measuring an initial speed of the hit golf ball (average value of n=5).

Results of test are shown in Table 3, and the specifications of the used golf balls A to Dare shown in Table 4, respectively.

TABLE 3

| | | COMPARATIVE EMBODIMENT 1 | COMPARATIVE EMBODIMENT 2 | COMPARATIVE EMBODIMENT 3 | EMBODIMENT 1 |
|---|---|---|---|---|---|
| SPECIFICATION OF HEAD | THICKNESS tf [mm] OF FACE PORTION | 2.5 | 2.5 | 3.1 | 2.0 |
| | THICKNESS tc [mm] OF CROWN PORTION | 1.0 | 1.5 | 1.5 | 0.9 |
| | THICKNESS ts [mm] OF SOLE PORTION | 1.0 | 1.5 | 2.0 | 0.9 |
| | RADIUS OF CURVATURE Rc [mm] OF CROWN PORTION | 400 | 400 | 300 | 800 |
| | RADIUS OF CURVATURE Rs [mm] OF SOLE PORTION | 500 | 800 | 500 | 1500 |
| | FREQUENCY F (fix) [Hz] INDICATING PRIMARY MINIMUM VALUE OF FREQUENCY TRANSFER COEFFICIENT IN ACCORDANCE WITH VIBRATOR METHOD | 900 | 1300 | 1300 | 600 |
| | FREQUENCY F (free) [Hz] INDICATING PRIMARY MINIMUM VALUE OF FREQUENCY TRANSFER COEFFICIENT IN ACCORDANCE WITH IMPACT HAMMER METHOD | 4500 | 3300 | 4500 | 2700 |
| RESULTS OF TEST | SPEED RATIO GOLF BALL A | 1.440 | 1.439 | 1.440 | 1.456 |
| | GOLF BALL B | 1.446 | 1.440 | 1.443 | 1.460 |
| | GOLF BALL C | 1.453 | 1.446 | 1.449 | 1.455 |
| | GOLF BALL D | 1.444 | 1.442 | 1.452 | 1.447 |

| | | EMBODIMENT 2 | EMBODIMENT 3 | EMBODIMENT 4 | EMBODIMENT 5 |
|---|---|---|---|---|---|
| SPECIFICATION OF HEAD | THICKNESS tf [mm] OF FACE PORTION | 2.0 | 2.2 | 2.2 | 2.3 |
| | THICKNESS tc [mm] OF CROWN PORTION | 0.9 | 0.9 | 0.9 | 1.0 |
| | THICKNESS ts [mm] OF SOLE PORTION | 0.9 | 0.9 | 0.9 | 1.0 |
| | RADIUS OF CURVATURE Rc [mm] OF CROWN PORTION | 600 | 800 | 700 | 600 |
| | RADIUS OF CURVATURE Rs [mm] OF SOLE | 1300 | 1500 | 1300 | 1100 |

TABLE 3-continued

| | | | | | |
|---|---|---|---|---|---|
| | PORTION | | | | |
| | FREQUENCY F (fix) [Hz] INDICATING PRIMARY MINIMUM VALUE OF FREQUENCY TRANSFER COEFFICIENT IN ACCORDANCE WITH VIBRATOR METHOD | 600 | 650 | 650 | 750 |
| | FREQUENCY F (free) [Hz] INDICATING PRIMARY MINIMUM VALUE OF FREQUENCY TRANSFER COEFFICIENT IN ACCORDANCE WITH IMPACT HAMMER METHOD | 3000 | 2800 | 3150 | 3400 |
| RESULTS OF TEST | SPEED RATIO GOLF BALL A | 1.461 | 1.464 | 1.469 | 1.464 |
| | GOLF BALL B | 1.464 | 1.471 | 1.473 | 1.468 |
| | GOLF BALL C | 1.462 | 1.466 | 1.472 | 1.472 |
| | GOLF BALL D | 1.457 | 1.459 | 1.468 | 1.468 |

| | | EMBODIMENT 6 | EMBODIMENT 7 | EMBODIMENT 8 | EMBODIMENT 9 |
|---|---|---|---|---|---|
| SPECIFICATION OF HEAD | THICKNESS tf [mm] OF FACE PORTION | 2.3 | 2.5 | 2.5 | 2.5 |
| | THICKNESS tc [mm] OF CROWN PORTION | 1.0 | 0.9 | 0.9 | 1.0 |
| | THICKNESS ts [mm] OF SOLE PORTION | 1.0 | 0.9 | 0.9 | 1.0 |
| | RADIUS OF CURVATURE Rc [mm] OF CROWN PORTION | 650 | 600 | 600 | 550 |
| | RADIUS OF CURVATURE Rs [mm] OF SOLE PORTION | 1050 | 1300 | 1200 | 1100 |
| | FREQUENCY F (fix) [Hz] INDICATING PRIMARY MINIMUM VALUE OF FREQUENCY TRANSFER COEFFICIENT IN ACCORDANCE WITH VIBRATOR METHOD | 900 | 900 | 900 | 900 |
| | FREQUENCY F (free) [Hz] INDICATING PRIMARY MINIMUM VALUE OF FREQUENCY TRANSFER COEFFICIENT IN ACCORDANCE WITH IMPACT HAMMER METHOD | 3700 | 3000 | 3200 | 3600 |
| RESULTS OF TEST | SPEED RATIO GOLF BALL A | 1.457 | 1.455 | 1.452 | 1.450 |
| | GOLF BALL B | 1.466 | 1.464 | 1.460 | 1.456 |
| | GOLF BALL C | 1.467 | 1.465 | 1.462 | 1.461 |
| | GOLF BALL D | 1.458 | 1.462 | 1.460 | 1.461 |

| | | EMBODIMENT 10 | EMBODIMENT 11 | EMBODIMENT 12 | EMBODIMENT 13 |
|---|---|---|---|---|---|
| SPECIFICATION OF HEAD | THICKNESS tf [mm] OF FACE PORTION | 2.5 | 2.8 | 2.8 | 3.0 |
| | THICKNESS tc [mm] OF CROWN PORTION | 1.0 | 0.9 | 1.0 | 1.0 |
| | THICKNESS ts [mm] OF SOLE PORTION | 1.0 | 0.9 | 1.0 | 1.0 |
| | RADIUS OF CURVATURE Rc [mm] OF CROWN PORTION | 500 | 600 | 550 | 500 |
| | RADIUS OF CURVATURE Rs [mm] OF SOLE PORTION | 1000 | 1200 | 1100 | 1000 |
| | FREQUENCY F (fix) [Hz] INDICATING PRIMARY MINIMUM VALUE OF FREQUENCY TRANSFER COEFFICIENT IN ACCORDANCE WITH VIBRATOR METHOD | 900 | 1100 | 1100 | 1200 |
| | FREQUENCY F (free) [Hz] INDICATING PRIMARY MINIMUM VALUE OF FREQUENCY TRANSFER COEFFICIENT IN ACCORDANCE WITH IMPACT HAMMER METHOD | 3900 | 3300 | 3700 | 4000 |
| RESULTS OF TEST | SPEED RATIO GOLF BALL A | 1.447 | 1.446 | 1.442 | 1.441 |
| | GOLF BALL B | 1.452 | 1.452 | 1.447 | 1.444 |
| | GOLF BALL C | 1.460 | 1.457 | 1.453 | 1.451 |
| | GOLF BALL D | 1.460 | 1.461 | 1.460 | 1.455 |

TABLE 4

| KIND OF GOLF BALL | FREQUENCY FB(fix) [Hz] INDICATING PRIMARY MINIMUM VALUE OF FREQUENCY TRANSFER FUNCTION IN ACCORDANCE WITH VIBRATING METHOD | FREQUENCY FB(free) [Hz] INDICATING PRIMARY MINIMUM VALUE OF FREQUENCY TRANSFER FUNCTION IN ACCORDANCE WITH IMPACT HAMMER METHOD |
|---|---|---|
| GOLF BALL A | 950 | 3240 |
| GOLF BALL B | 980 | 3400 |
| GOLF BALL C | 1040 | 3400 |
| GOLF BALL D | 1100 | 4100 |

As a result of the test, in the head of the embodiment, the speed ratio is generally increased with respect to the golf balls A to D, and the improvement of the repulsion performance can be confirmed. As mentioned above, in accordance with the golf club head of the present invention, since the frequencies which the primary minimum values of the frequency transfer functions measured in accordance with the vibrator method and the impact hammer method indicate can be limited to a fixed range, that is, the frequencies F (fix) and F (free) indicating the primary minimum values of the frequency transfer function of the head approximate to those of the golf ball in any boundary condition of the fixed state of the head and the free state of the head, it is possible to further increase the repulsion against the ball rather than the conventional one, whereby it is possible to further increase the carry of the ball.

The invention claimed is:

1. A golf club head having a face portion, a crown portion forming a head upper surface, and a sole portion forming a head bottom surface, and wherein a thickness of the face portion is not more than 2.7 mm, a thickness of the crown portion is not more than 0.9 mm, a thickness of the sole portion is not more than 1.0 mm, and the head, when mounted on a horizontal surface to have a set lie angle and face angle, with a vertical cross section passing through a center of the face portion and being perpendicular to the face surface and said horizontal surface, has (1) a smallest radius of curvature of an outer surface in the crown portion of not less than 500 mm, measured at the vertical cross section, and (2) a smallest radius of curvature of an outer surface in the sole portion of not less than 1000 mm, measured at the vertical cross section, and wherein a frequency F (fix) indicating a primary minimum value of a frequency transfer function of a head obtained by firmly fixing the head to a vibrator and measured in accordance with a vibrator method is between 600 and 1200 Hz, a frequency F (free) indicating a primary minimum value of a frequency transfer function of the head obtained by placing the head in a free state and measured in accordance with an impact hammer method is between 2500 and 4000 Hz, and a ratio F (free)/F (fix) between said frequency F (fix) and said frequency F (free) is between 4.2 and 6.0.

2. A golf club head according to claim 1, wherein said frequency F (fix) is between 600 and 1000 Hz, and said frequency F (free) is between 2500 and 3800 Hz.

3. A golf club head according to claim 1, wherein said frequency F (fix) is between 600 and 900 Hz, and said frequency F (free) is between 2500 and 3500 Hz.

4. A golf club having the head according to claim 1.

5. A golf club head according to claim 1, wherein the golf club head comprises a hollow, metallic structure.

6. A golf club head according to claim 1, wherein the head has a smallest radius of curvature of an outer surface in the crown portion of 600 to 800 mm, measured at the vertical cross section.

7. A golf club head according to claim 1, wherein the head when mounted on a horizontal surface to have a set lie angle and face angle, with a vertical cross section passing through a center of the face portion and being perpendicular to the face surface and said horizontal surface, has a smallest radius of curvature of an outer surface in the sole portion of 1200 to 1500 mm, measured at the vertical cross section.

8. A golf club head according to claim 1, wherein the head when mounted on a horizontal surface to have a set lie angle and face angle, with a vertical cross section passing through a center of the face portion and being perpendicular to the face surface and said horizontal surface, has a ratio of a smallest radius of curvature of an outer surface in the crown portion, measured at the vertical cross section, to a smallest radius of curvature of an outer surface in the sole portion, measured at the vertical cross section, in the range of 0.4 to 0.6.

9. A golf club head according to claim 1, wherein said frequency F (free) is between 2500 and 3500 Hz.

10. A golf club head having a hollow, metallic structure comprising a face portion, a crown portion forming a head upper surface, and a sole portion forming a head bottom surface, wherein the head has a frequency F(fix) of a primary minimum value of a frequency transfer function of between 600 and 1200 Hz obtained by firmly fixing the head to a vibrator and measured in accordance with an vibrator method, and a frequency F(free) of a primary minimum value of a frequency transfer function of between 2500 and 4000 Hz obtained by placing the head in a free state and measured in accordance with an impact hammer method, and wherein the head when mounted on a horizontal surface to have a set lie angle and face angle, with a vertical cross section passing through a center of the face portion and being perpendicular to the face surface and said horizontal surface, has a ratio of a smallest radius of curvature of an outer surface in the crown portion, measured at the vertical cross section, to a smallest radius of curvature of an outer surface in the sole portion, measured at the vertical cross section, in the range of 0.4 to 0.6.

11. A golf club head according to claim 10, wherein said frequency F (free) is between 2500 and 3500 Hz.

12. A golf club head according to claims 10 or 11, wherein a ratio F (free)/F (fix) between said frequency F (fix) and said frequency F (free) is between 4.2 and 6.0.

13. A golf club head according to claim 1, wherein the golf club head is formed substantially from a metallic alloy.

14. A golf club head having a face portion, a crown portion forming a head upper surface, and a sole portion forming a head bottom surface, and wherein the face portion has a thickness of not more than 2.7 mm, the crown portion has a thickness of not more than 0.9 mm, and the sole portion has a thickness of not more than 1.0 mm, and wherein a frequency F (fix) indicating a primary minimum value of a frequency transfer function of a head obtained by firmly fixing the head to a vibrator and measured in accordance with a vibrator method is between 600 and 1200 Hz, a frequency F (free) indicating a primary minimum value of a frequency transfer function of the head obtained by placing the head in a free state and measured in accordance with an impact hammer method is between 2500 and 4000 Hz, and a ratio F (free)/F (fix) between said frequency F (fix) and said frequency F (free) is between 4.2 and 6.0.

15. A golf club head according to claim 14, wherein the face portion has a thickness of about 2.0 to 2.7 mm, the crown portion has a thickness of about 0.5 to 0.9 mm, and the sole portion has a thickness of about 0.5 to 1.0 mm.

16. A golf club head according to claim 14, wherein the face portion has a thickness of about 2.3 to 2.7 mm, the crown portion has a thickness of about 0.7 to 0.9 mm, and the sole portion has a thickness of about 0.7 to 1.0 mm.

17. A golf club head in which a frequency F (fix) indicating a primary minimum value of a frequency transfer function of a head obtained by firmly fixing the head to a vibrator and measured in accordance with an vibrator method is between 600 and 1200 Hz, a frequency F (free) indicating a primary minimum value of a frequency transfer function of the head obtained by placing the head in a free state and measured in accordance with an impact hammer method is between 2500 and 4000 Hz, and a ratio F (free)/F (fix) between said frequency F (fix) and said frequency F (free) is between 4.2 and 6.0, and wherein the golf club head is formed substantially from a metallic alloy, and the golf club head has a crown portion having a thickness of not more than 0.9 mm.

* * * * *